US011772286B2

(12) United States Patent
Barr

(10) Patent No.: US 11,772,286 B2
(45) Date of Patent: Oct. 3, 2023

(54) LOW PROFILE POCKET TOOL

(71) Applicant: Caffeinate Labs Inc., Beverly, MA (US)

(72) Inventor: Nathan Gregg Barr, Portland, ME (US)

(73) Assignee: Caffeinate Labs Inc., Portland, ME (US)

( * ) Notice: Subject to any disclaimer, the term of this patent is extended or adjusted under 35 U.S.C. 154(b) by 1603 days.

(21) Appl. No.: 15/811,291

(22) Filed: Nov. 13, 2017

(65) Prior Publication Data

US 2018/0065260 A1 Mar. 8, 2018

Related U.S. Application Data

(63) Continuation of application No. 14/590,980, filed on Jan. 6, 2015, now Pat. No. 9,815,212.

(60) Provisional application No. 62/095,697, filed on Dec. 22, 2014, provisional application No. 61/934,352, filed on Jan. 31, 2014.

(51) Int. Cl.

| | |
|---|---|
| ***B26B 1/04*** | (2006.01) |
| ***B26B 5/00*** | (2006.01) |
| ***A45D 24/06*** | (2006.01) |
| ***A45D 24/08*** | (2006.01) |

(52) U.S. Cl.

CPC ..... *B26B 1/044* (2013.01); *A45D 24/06* (2013.01); *A45D 24/08* (2013.01); *B26B 5/00* (2013.01)

(58) Field of Classification Search

CPC ..... B26B 1/02; B26B 1/044; B26B 1/046; B26B 1/048; B26B 1/10; B26B 3/06; B26B 11/00; B26B 11/001; B26B 11/003; B26B 11/006

USPC ..... D8/98–100, 105; D22/118; 30/152–161

See application file for complete search history.

(56) References Cited

U.S. PATENT DOCUMENTS

| | | | |
|---|---|---|---|
| 23,975 | A | 5/1859 | Belcher |
| 589,738 | A | 9/1897 | Miller |
| 821,176 | A | 5/1906 | Leland |
| 1,049,931 | A | 1/1913 | Smith |
| 1,298,944 | A | 4/1919 | Hemming |
| 1,357,398 | A | 11/1920 | Haywood |
| 1,458,789 | A | 6/1923 | Widas et al. |

(Continued)

FOREIGN PATENT DOCUMENTS

| | | | |
|---|---|---|---|
| CA | 2938397 A1 * | 8/2015 | ..... B26B 1/044 |
| CA | 2938397 A1 | 8/2015 | |

(Continued)

OTHER PUBLICATIONS

PCT International Search Report, and Written Opinion of the International Searching Authority; PCT Application No. PCT/US2015/014144, dated May 8, 2015.

*Primary Examiner* — Jason Daniel Prone

(74) *Attorney, Agent, or Firm* — Jodi-Ann McLane

(57) ABSTRACT

This invention is directed toward a versatile, low profile pocket tool. The pocket tool contains only a single backing plate and can be made without using any screws, pins, or other fasteners. In that way, the implements can easily be removed and interchanged. The stability of the pocket tool is gained by using an tabs that interlock around a track on the implement. This interlocking facilitates rotation and stability. In embodiments, there can be a single tab and a single track, or multiple tabs and multiple tracks.

11 Claims, 17 Drawing Sheets

(56) References Cited

U.S. PATENT DOCUMENTS

| | | | | |
|---|---|---|---|---|
| 1,510,420 | A | | 9/1924 | Sherman |
| 1,701,027 | A | | 2/1929 | Brown |
| 1,717,925 | A | | 6/1929 | Horix |
| D105,334 | S | | 7/1937 | Mahoney |
| 2,183,901 | A | | 12/1939 | Weaver |
| 2,199,430 | A | | 5/1940 | Greve |
| 2,286,524 | A | | 6/1942 | Wilbur |
| 2,558,265 | A | | 6/1951 | Mosch |
| 2,596,294 | A | | 5/1952 | Schrade |
| D183,333 | S | | 8/1958 | Walker |
| 3,263,329 | A | | 8/1966 | Hennessy |
| 3,461,469 | A | | 8/1969 | Morrision |
| 3,600,729 | A | | 8/1971 | Laughlin |
| 3,942,249 | A | | 3/1976 | Poehlmann |
| 4,078,272 | A | | 3/1978 | Mahon, III |
| 4,133,106 | A | | 1/1979 | Addis |
| 4,312,128 | A | | 1/1982 | Olsen |
| 4,354,313 | A | | 10/1982 | Naifeh |
| 4,404,748 | A | | 9/1983 | Wiethoff |
| 4,439,922 | A | | 4/1984 | Sassano |
| 4,442,559 | A | | 4/1984 | Collins |
| 5,815,927 | A | | 10/1998 | Collins |
| 6,101,722 | A | | 8/2000 | Cheng |
| 6,101,724 | A | | 8/2000 | Halligan |
| 6,105,255 | A | | 8/2000 | Cheng |
| 6,145,994 | A | | 11/2000 | Ng |
| 6,360,443 | B1 | | 3/2002 | Remus |
| 7,555,839 | B2 | | 7/2009 | Koelewyn |
| 7,676,932 | B2 | | 3/2010 | Grice |
| 7,716,839 | B2 | | 5/2010 | Onion et al. |
| 8,087,173 | B2 | | 1/2012 | Tang et al. |
| 8,307,555 | B2 | | 11/2012 | Onion |
| 8,528,215 | B2 | | 9/2013 | Elsener |
| D765,487 | S | * | 9/2016 | Barr ..... D8/99 |
| D766,061 | S | * | 9/2016 | Barr ..... D8/99 |
| D767,363 | S | * | 9/2016 | Barr ..... B26B 1/044 D8/99 |
| D772,677 | S | * | 11/2016 | Celestine ..... D8/105 |
| D773,273 | S | * | 12/2016 | Celestine ..... D8/105 |
| D799,299 | S | * | 10/2017 | Suhami ..... D8/105 |
| 9,815,212 | B2 | * | 11/2017 | Barr ..... B26B 1/044 |
| D815,935 | S | * | 4/2018 | Barak ..... D8/105 |
| D858,234 | S | * | 9/2019 | Barr ..... D8/38 |
| D874,241 | S | * | 2/2020 | Liao ..... D8/105 |
| D877,594 | S | * | 3/2020 | Liang ..... D8/105 |
| D878,891 | S | * | 3/2020 | Polczynski ..... D8/105 |
| D881,671 | S | * | 4/2020 | Kao ..... D8/105 |
| D886,564 | S | * | 6/2020 | Dittmer ..... D8/55 |
| D934,048 | S | * | 10/2021 | Polczynski ..... D8/105 |
| 2004/0134075 | A1 | | 7/2004 | Chu |
| 2006/0080841 | A1 | | 4/2006 | Hatcher et al. |
| 2007/0044323 | A1 | | 3/2007 | Chao |
| 2008/0172884 | A1 | | 7/2008 | Cheng |
| 2012/0192434 | A1 | | 8/2012 | Syrjala |
| 2016/0303746 | A9 | * | 10/2016 | Barr ..... B26B 1/044 |

FOREIGN PATENT DOCUMENTS

| | | | | |
|---|---|---|---|---|
| CN | 202452322 | U | 9/2012 | |
| DE | 2146066 | A1 | 4/1973 | |
| DE | 2206818 | A1 | 8/1973 | |
| FR | 2609923 | | 7/1988 | |
| WO | WO-9318693 | A1 * | 9/1993 | ..... B26B 1/046 |
| WO | 2015117101 | A1 | 8/2015 | |

* cited by examiner

LOW PROFILE POCKET TOOL

CROSS-REFERENCE TO RELATED APPLICATIONS

This application is a continuation of U.S. patent application Ser. No. 14/590,980 (now U.S. Pat. No. 9,815,212), entitled "Low Profile Pocket Tool," filed on Jan. 6, 2015, which claims priority to the following U.S. Provisional Patent Applications: Provisional Patent Application No. 61/934,352, entitled "Personal Utility Device, Pocket Knife and Related Methods," filed on Jan. 31, 2014; and Provisional Patent Application No. 62/095,697, entitled "Personal Utility Device, Pocket Knife and Related Methods," filed Dec. 22, 2014, the entire contents of which are hereby incorporated by reference.

FIELD

The present invention relates generally to a low profile tool, and in one embodiment, a low profile pocket knife.

BACKGROUND

Pocket knives have been a useful tool for a variety of applications for more than a century and a half. By way of example, U.S. Pat. No. 23,975, entitled "Pruning Knife," issued to G. G. Belcher in 1859 was directed to a pocket knife. Although pocket knives have been around for more than a century and a half, their design has not changed that much during that time. Compare for example U.S. Pat. No. 7,555,839, issued to Koelewyn, entitled "Fishing Knife" to Belcher's "Pruning Knife." Aside from the specific features in the Koelewyn blade that facilitate cutting fishing lines, the basic design of the Koelewyn pocket knife, patented in 2009 and the Belcher pocket knife, patented in 1859 is the same. Both have a front and a back plate encasing the knife blade, both are held together using pins, and both have a profile that is likely an inch or higher.

Although the basic design of the pocket knife has not changed substantially over time, inventors have enhanced functionality by for example adding multiple tools to the traditional design. See e.g., U.S. Pat. No. 8,528,215, issued to Elsner, entitled "Pocket Tool, in Particular a Pocket Knife." When a pocket knife is carried on one's person, it can be heavy and bulky in a pocket or on a belt. When pocket knives are carried in purses, they can be hard to find.

It would be advantageous, therefore, to create a lightweight, low profile knife while still maintaining the functionality of the traditional pocket knife or the enhanced functionality of a pocket tool. It is thus desirable to design a pocket knife having a profile low enough to fit inside of a wallet. In that way, the pocket knife or low profile tool could be placed right inside of one's wallet, which would make it easier to find and less cumbersome than carrying a heavier, more traditional pocket tool.

In designing a sleeker, more modern pocket knife, an additional consideration relevant to modern life is the security risks posed by pocket knives at checkpoints such as airport security checkpoints. In these situations, it is often prohibited to carry a pocket knife or pocket tool having a sharp implement that could be used as a weapon onto an airplane, for example. Airline passengers who forget to remove their pocket knives from their person or carry-on luggage at airport screening checkpoints frequently must forfeit their pocket knife in order to board their plane. This can be a costly loss to air travelers.

It would be additionally advantageous, therefore to add a feature to the sleeker, low profile tool that would allow an airline traveler or anyone else faced with the choice of forfeiting his or her tool in order to enter someplace the ability to easily remove the sharp implement from the body of the tool. In this way, the traveler, for example, could retain the body of the pocket tool, while only having to forfeit an offending sharp implement. This would allow the knife owner to replace the knife blade or saw, for example, at a later time and at a relatively low cost.

SUMMARY OF THE INVENTION

The invention disclosed herein overcomes some of the shortcomings of the prior art by being of a relatively small thickness as well as providing for the removal and replacement of implements without having to use a tool. The profile of the tool is kept to a minimum by virtue of using only a single backing plate as well as avoiding the use of pins, rivets, screws, and similar fasteners. The removability feature is accomplished by providing a tabbing mechanism on the backing plate that interlocks with a track feature on the implement to form a rotational orbital track. The interlocking tab and track portions of the backing plate and implement, respectively, also add stability to the implement when it is in rotation or in an open position.

In some embodiments, there is provided a low profile pocket tool comprising: a backing plate further comprising a first tab, a leaf spring and at least one implement guard; wherein the leaf spring further comprises an implement catch portion; and an implement further comprising a first cutout located within an orbital track and a second cutout configured to couple to the implement catch portion when the implement is in a closed position, wherein the orbital track is configured to interlock with the backing plate to allow constrained rotational movement of the implement.

An alternate embodiment provides that the implement is chosen from the group consisting of a knife blade, a screwdriver, a saw, a wrench, an allen key, a box opener, a letter opener, a lock pick, a fruit peeler, a ruler, a hair comb, a seat belt cutter, a glass shattering tool, a bottle opener, a can opener, scissors, a chisel, and a wire cutter.

In some embodiments, the implement is removable.

In some embodiments, the thickness of the backing plate is nearly identical to a thickness of the implement. In alternate embodiments, a combined thickness of the backing plate and the implement is less than or equal to 4 millimeters.

In some embodiments, there is a second implement guard. In some embodiments, at least one implement guard is integral to the backing plate. In additional embodiments, at least one implement guard is tapered such that it is thicker on an edge proximal to the backing plate. In alternate embodiments, the tapering is inversely proportional to a thickness of a front portion of the implement as it tapers to a back portion of the implement when the implement is in the closed position.

In yet other embodiments, the low profile pocket tool could further comprise: a second tab wherein a length of the first tab is different than a length of the second tab; and a first cutout and a second cutout surrounding the first tab and the second tab when the implement is an insertion position, wherein the orbital track is configured to interlock with the first tab and the second tab to allow rotational movement of the implement. Additional embodiments could comprise a third tab; and a third cutout surrounding the third tab when the implement is in an insertion position, wherein the orbital track is configured to interlock with the third tab to allow rotational movement of the implement.

In some embodiments, the low profile pocket tool be designed such that the first tab is shorter than the second tab further comprising: the first tab is wider along an outer arc edge than an outer arc edge of the second tab; the first cutout is sized in relation to the width of the first tab and the second cutout is sized in relation to the width of the second tab, thereby creating an inner orbital track and an outer orbital track; the inner and outer orbital tracks are concentric; the inner track is broken by the first cutout and the second cutout; and the outer track is broken by the second cutout.

In an alternate embodiment, the low profile pocket tool could be designed such that it further comprises: a third tab; and a third cutout surrounding the third tab when the implement is in an insertion position, wherein the orbital track is configured to interlock with the third tab to allow rotational movement of the implement.

In yet an alternate embodiment of the low profile tool the first tab, the second tab, and the third tab have varying lengths further comprising: the first tab is wider along an outer arc edge than an outer arc edge of the second tab; the second tab is wider along an outer arc edge than an outer arc edge of the third tab; the first cutout is sized in relation to the width of the first tab; the second cutout is sized in relation to the width of the second tab; the third cutout is sized in relation to the width of the third tab; the first cutout, second cutout, and third cutout formed so as to create an inner orbital track, a middle orbital track and an outer orbital track; the inner, middle, and outer orbital tracks are concentric; the inner track is broken by the first cutout, the second cutout, and the third cutout; the middle track is broken by the second cutout and the third cutout; and the outer track is broken by the third cutout.

In some embodiments, the leaf spring further comprises an implement retention boss.

In alternate embodiments, the backing plate further comprises an implement catch portion that is integral to the backing plate.

In additional embodiments, the backing plate further comprises a blade pivot boss.

In yet additional embodiments, there could be a second tab on the backing plate; a first backing plate cutout and a second backing plate cutout; and a first blade pivot track and a second blade pivot track. In an alternate embodiment, there could be a third implement pivot track. In these embodiments, the implement pivot tracks could optionally be integral to the implement.

In still other embodiments, there could be a third tab on the backing plate; a third backing plate cutout; and a fourth blade pivot track integral to the implement.

In yet another embodiment, there could be a low profile pocket tool comprising: a backing plate further comprising a first cutout located within an orbital track and a portion of the implement configured to couple to the implement catch portion when the implement is in a closed position, wherein the orbital track is configured to interlock with the backing plate to allow constrained rotational movement of the implement; and an implement further comprising a first tab, a leaf spring and at least one implement guard; wherein the leaf spring further comprises an implement catch portion.

DETAILED DESCRIPTION

Those of skill in the art will recognize throughout this specification that when like terms are used to describe features and functionalities of various portions of a particular embodiment, those same features and functionalities could be present in additional embodiments having aspects with like terms.

Figure 1A:
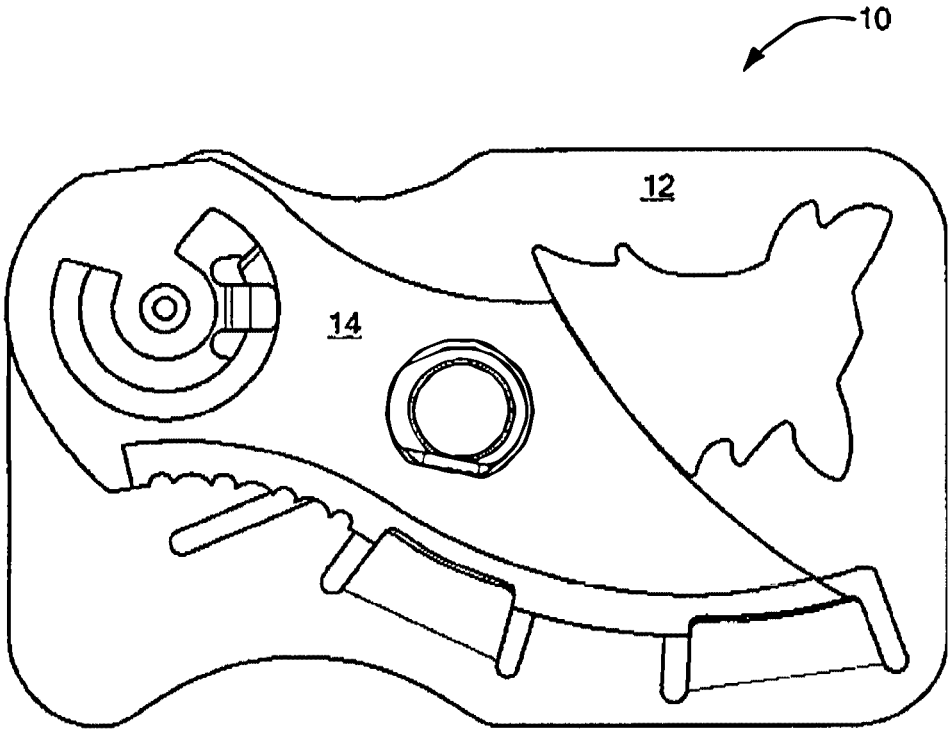
FIG. 1A is a front view of an embodiment of the low profile pocket tool. In this embodiment, the pocket tool is a pocket knife and it is shown in the closed position.
Figure 1B:
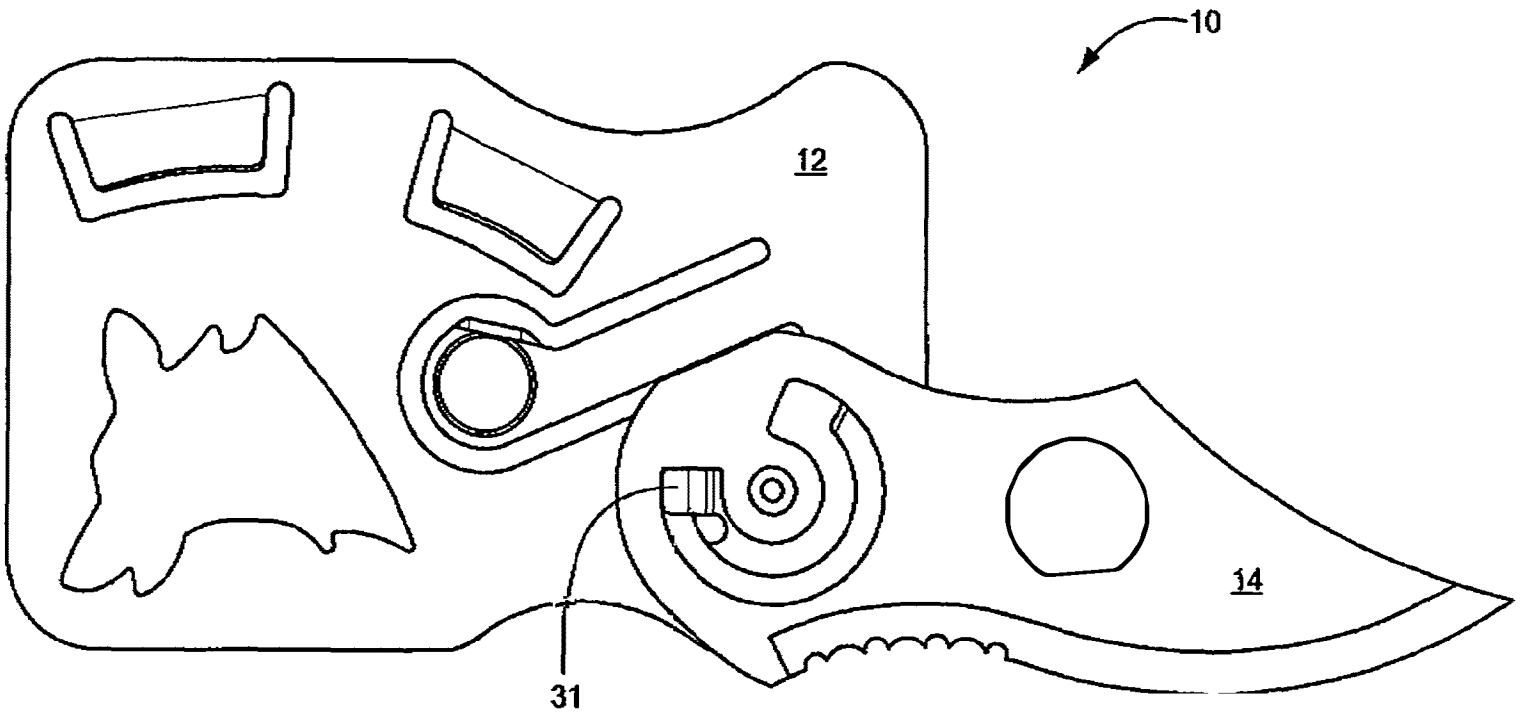
FIG. 1B is a front view of a pocket knife embodiment in the open position.

FIG. 1A and FIG. 1B show a low profile pocket tool 10 having a backing plate 12 and an attached implement 14, which in one embodiment could be a knife blade. In this embodiment, the attached implement 14 is depicted in the closed position. Generally speaking, the embodiments disclosed herein can have the following attributes. The low profile pocket tool 10 embodiments can be made of stainless steel, aluminum, steel, titanium, plastic, carbon fiber, ceramic, or similar material. In these embodiments, the backing plate 12 and the implement 14 could be made of the same material or different materials.

In terms of creating a pocket tool 10 that is low profile, the profile of an average credit card is 0.8 millimeters. It is desirable, although not necessary, in embodiments described herein to limit the overall profile of the pocket tool 10 to be 4 millimeters or less. In alternate embodiments, the thickness of the pocket tool could be less than 4 millimeters. In a preferred embodiment, the thickness could be less than three times the thickness of a credit card.

In some embodiments, the thickness of the implement 14 could be the same or nearly identical to the thickness of the backing plate 12. In one embodiment, the thickness of the implement 14 could be within 10%, 20% or 30% of the thickness of the backing plate 12. In alternate embodiments, when looking at the overall profile of the pocket tool 10, the protrusions of each part of the implement 14 and the backing plate 12 would not extend significantly beyond the overall thickness of the pocket tool 10. In one such embodiment, the protrusions of each part of the implement 14 and the backing plate 12 would not extend more that 30% of the overall thickness of the pocket tool 10.

The embodiments disclosed herein are an advancement over many prior art pocket tools because they use only one backing plate 12 as opposed to two, which is much more common in prior art pocket tools. The use of just a single backing plate 12 substantially reduces the overall thickness and the weight of the pocket tool 10.

In addition, embodiments disclosed herein have the advantage of having no pins, rivets, screws, bolts or similar fastening mechanisms used to attach implements, guard tabs, buckles, and similar accessories to the pocket tool. By eliminating these fastening means, the present embodiments have the advantage of being lighter and less susceptible to breakage or loss of an accessory due to a loose fastener.

In some embodiments, the implement is removable. While removable implements in pocket tools are evidenced in the prior art, those implements were attached using one of the above-delineated fastening means. In embodiments of the low profile pocket tool 10, the implement 14 is held securely in place via a tabbing mechanism that will be described in further detail below. This means of securing an implement 14 to the backing plate 12 has the advantage that the implement 14 can be removed without the use of tools.

The tabbing mechanisms disclosed herein are superior to requiring the use of a tool to remove an implement 14 because the owner of the pocket tool 10 will have the freedom to remove or replace implements 14 without having to also have a tool designed for removal in his or her possession. This convenience makes the disclosed embodiments attractive to consumers because if, for example, they were at an airport security check point and removing the implement 14 required a tool that the owner left at home, he or she would still be able to remove the prohibited implement 14, e.g., a knife blade, without having to leave the entire pocket tool 10 at the airport.

Throughout this application, the figures depict a knife blade as the preferred implement 14 to be used in the low profile pocket tool. Those of skill in the art, however, will recognize that the teachings of this application are equally relevant to a wide variety of tools that could be used as implements in the low profile pocket tool. By way of example, and without limitation, implements 14 of this invention could include a screwdriver, a saw blade, a wrench, an allen key, a box opener, a letter opener, a lock pick, a fruit peeler, a ruler, a hair comb, a seat belt cutter, a glass shattering tool, a bottle opener, a can opener, scissors, a chisel, and a wire cutter.

Figure 2:
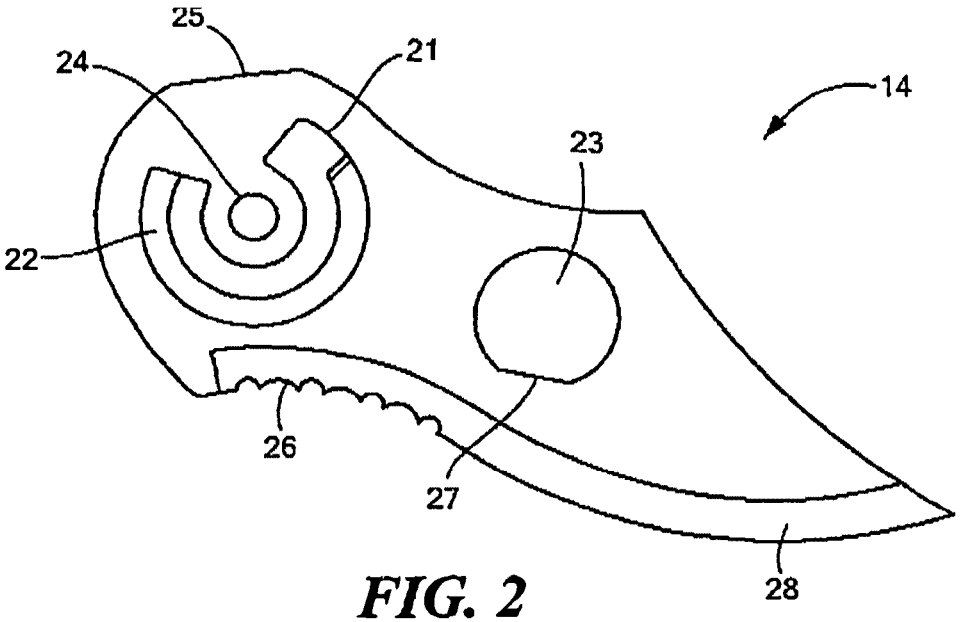
FIG. 2 is a front view of an implement, namely a knife blade, that could be used with a pocket knife embodiment of the present invention.

FIG. 2 shows illustrates the features of an implement 14, wherein the implement is a knife blade. Throughout the discussion of embodiments having a knife blade as the implement 14, the terms knife blade and implement 14 will be used interchangeably with reference to the description of the figures with the understanding that those of skill in the art will readily recognize that the implement 14 could be numerous tools and not just a knife blade. The design features of the knife blade 14 shown in FIG. 2 and subsequent figures in this application could be replicated in additional implements, e.g., a saw, a screwdriver and so on.

Turning specifically to the embodiment depicted in FIG. 2, the knife blade 14, is depicted with two types of cutting edges—a smoothly sharpened edge 28 and a serrated edge 26. In alternate embodiments, the knife blade 14 could have only a sharpened edge 28 or only a serrated 26 edge. Moreover, the edge of the knife blade 14 is depicted as being curved. In alternate embodiments, the edge could be a straight edge as well. Irrespective of any of these combinations of edge type, the thickness of the edge of the knife blade 14 could be tapered to enhance its functionality. For example, the knife blade 14 could be its thinnest along the outer perimeter of smoothly sharpened edge 28 and serrated edge 26.

The knife blade 14 also contains an orbital track comprised of a cutout portion 21 and an recessed portion 22. The orbital track is configured to interlock with a tab 31, shown in FIG. 3, on the backing plate 12 to constrain rotational movement of the implement 14 in the same plane as the backing plate 12. Those of skill in the art will recognize that alternate embodiments having an orbital track that interlocks with a single tab or a plurality of tabs function similarly and are thus contemplated and disclosed herein. The implement 14 further contains a first cutout 24 located within the orbital track. This first cutout 24 creates an axis of rotation for the implement 14 when the first cutout 24 is coupled to the backing plate 12, e.g., by coupling to an implement pivot boss 37.

Those of skill in the art will recognize that the orbital track could be formed on the backing plate 12, and the first tab 31 could be formed on the implement 14. This reversal of locations for the orbital track, in all of its various permutations, and the first tab 31 or plurality of tabs, in all of their various permutations described herein could be accomplished for all embodiments.

The implement pivot boss 37 could be integral to the backing plate 12 if, for example, it was stamped into the backing plate 12. Additionally, the implement pivot boss 37 could be welded onto the backing plate 12 or it could be a screwed into the backing plate 12. In some embodiments, the coupling between the first cutout 24 and the implement pivot boss 37 could be a direct coupling, e.g., an interlocking. In alternate embodiments, there could be a washer, gasket, or similar device positioned between the first cutout 24 and the implement pivot boss 37, which would still facilitate an interlocking with the backing plate 12.

The implement catch coupling 23 is configured to connect with an implement catch portion 33 on the backing plate 12. The implement catch portion 33 could be a raised button pressed into the backing plate 12 as well as a catch mechanism or a raised portion along the leaf spring 32. Irrespective of which of these types of mechanisms is employed, the function of the implement catch portion 33 is to secure the implement when it is in a closed position. The implement catch portion 33, which is located on a leaf spring 32 exerts an upward force on the implement 14 when the implement catch portion 33 is positioned inside a portion of the implement configured to couple to the implement catch portion, implement catch coupling 23. In some embodiments, the implement catch portion 23 could be a cutout. Those of skill in the art, however, will recognize that the implement catch portion 23 could be a thinned portion of the implement 14, or an opening of varying shape. Although the implement catch coupling 23 is pictured as substantially circular, those of skill in the art will recognize that the shape of the implement catch coupling 23 could be square, rectangular, triangular, trapezoidal, hexagonal, octagonal, or any other geometric shape that would exert an upward force on the implement 14 thereby securing it when the implement 14 is in a closed position.

The orbital track, comprised of a cutout portion 21 and a recessed portion 22, is configured to allow rotation of the implement. In addition, because the orbital track has a gap, it can, in some embodiments, allow the implement 14 to be removed. When the implement 14 is rotated in such a way so to allow the first tab 31 on the backing plate 12 is positioned within the gap of the orbital track, the implement 14 can be removed. In alternate embodiments described throughout, the orbital track could form a continuous circle or other configuration thereby creating a permanently affixed implement.

In terms of rotation of the implement, the first tab 31 of the backing plate 12 is configured to slide along the cutout portion 21. The recessed portion 22 keeps the implement 14 rotating in a single plane without allowing it to accidentally fall off of the orbital track. Allowing the implement 14 to rotate allows it to go from a closed position to an open position. Rotation can also allow the implement 14, in some embodiments, to be removed.

When the implement 14 is in the closed position, it is held securely closed by the implement guards 34 as well as the force exerted on the flat portion of the cutout 27 by implement retention boss 35. Implement retention boss 35 is high enough to provide a downward force on the cutout flat 27, while being low enough to allow the implement 14 to slide up and over it when a user desires to rotate the implement 14 from a closed position to an open position.

Similarly, the flat portion of the implement 25 serves to secure the implement 14 in an open position by virtue of the force applied to implement flat 25 by the leaf spring 32.

Figure 3:
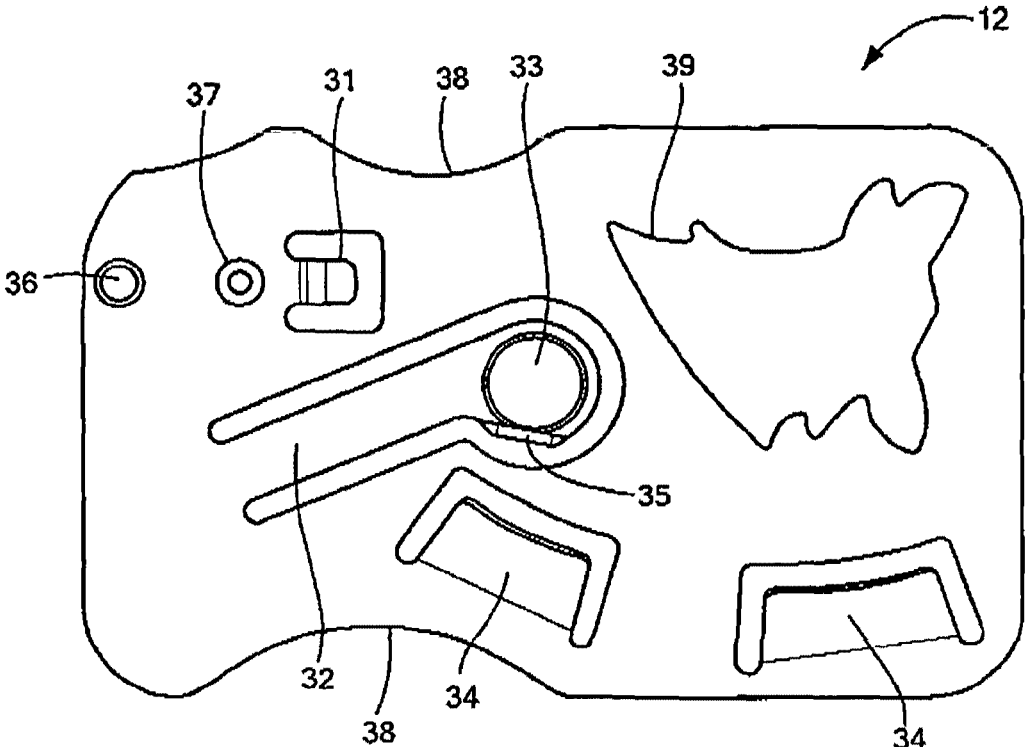
FIG. 3 is a front view of a blacking plate used in a pocket knife embodiment.

FIG. 3 depicts an embodiment of a backing plate 12. In this embodiment, the backing plate 12 contains two implement guards 34. In an alternate embodiment, there could be a single implement guard 34. In some embodiments the implement guard 34 could be tapered to accommodate the thickness of the implement 14. In one embodiment where the implement 14 is a knife blade, the knife blade would likely be the thinnest at its outer edge.

If the implement guard 34 was tapered to accommodate the thickness of a knife blade, it would be thickest at an edge proximal to the backing plate 12 and progressively thinner moving toward the edge of the implement guard 34 that was furthest from the backing plate 12. In one embodiment, the combined thickness of the implement 14 and the implement guard 34 would remain constant over the taper. In yet an alternate embodiment, the implement guard 34 could be integral to the backing plate 12. For example, the implement guard 34 could be pressed into the backing plate 12.

In addition, the backing plate 12 includes a leaf spring 32. As those of skill in the art will recognize, a leaf spring 32 is created with a natural bend therein that exerts an upward force. Those skilled in the art will recognize that the functionality of a leaf spring could likewise be accomplished by having a slight angle in the backing plate 12 that applied a stabilizing force when the implement 14 was opened or closed. Accordingly, the term "leaf spring" is to be given its broadest construction in accordance with its function.

The leaf spring 32 in the backing plate 12 is integral to the backing plate 12 and could be formed with a press or similar machine. The leaf spring 32, which also contains an implement catch portion 33, exerts an upward force on the implement 14 thereby securing the implement when it is in a closed position.

In terms of confining the implement 14 to a circular rotation about an axis point created by a first cutout 24, a first tab 31 on the backing plate is constructed so as to fit within the cutout portion 21 and a recessed portion 22 of the orbital track. The upper portion of the first tab 31 rides in the recessed portion 22 of the orbital track. With this geometry, the first tab 31 facilitates rotation of the implement 14, while simultaneously constraining its axis of rotation to a single plane.

FIG. 1B shows how the first tab 31 attaches to the cutout portion 21 and the recessed portion 22 of the orbital track when the implement 14 is in the open position. Moving from the open position to the closed position, the first tab 31 continues to remain in contact with the cutout portion 21 and the recessed portion 22 of the orbital track so as to create rotational stability for the implement. In some embodiments, the first tab 31 can be made integral to the backing plate 12 by stamping, pressing, welding, or the like it into the backing plate 12.

Optionally, the backing plate 12 could also contain an additional implement retention boss 36 that would apply an additional force to the implement such that the implement would be constrained during rotation about its axis of rotation. As those skilled in the art will recognize, a "boss" provides a contact surface around an opening or hole. The contact surface could be created by any formed feature, e.g., a bent edge. Therefore, the term "boss" as used throughout is intended to be construed in its broadest sense. The additional retention boss 36 contacts the opposite side of the implement 14, opposite from recessed portion 22 in order to take up any tolerance and keep the implement 14 from moving out of plane with the respect to the backing plate 12. Also optionally, embodiments of the backing plate 12 could include a bottle opener 39. The bottle opener could be a fanciful shape, e.g., a wolf's head, in some embodiments.

Figure 4:
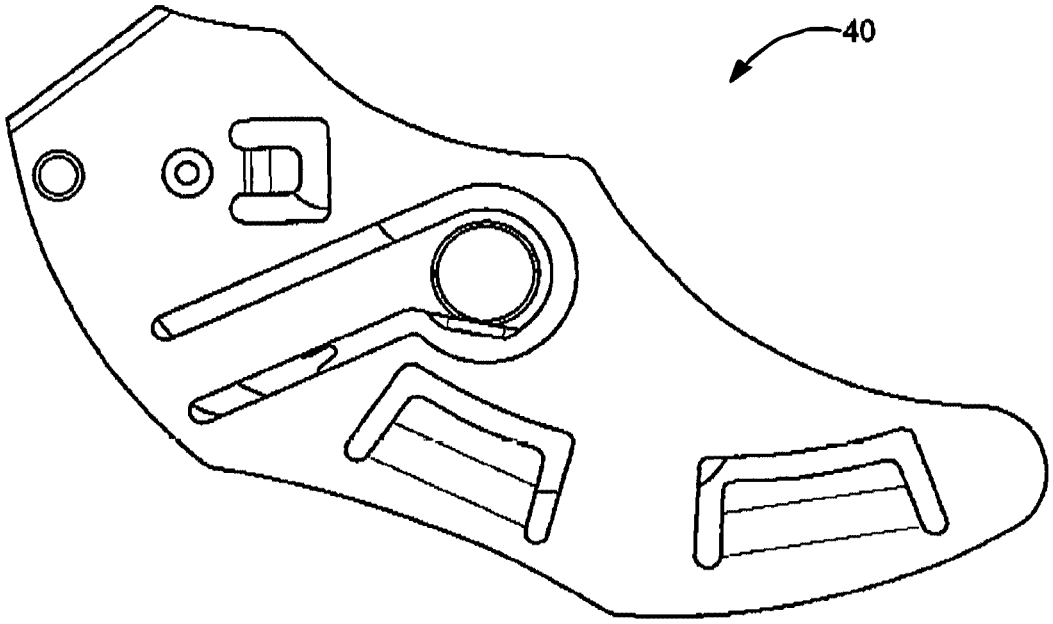
FIG. 4 is a front view of an alternate embodiment of a backing plate that can be used in embodiments of the present invention.

FIG. 4 shows an alternate embodiment of the backing plate 40. In this embodiment, the features of the backing plate 40 are similar as to those described with respect to backing plate 12.

Figure 5:
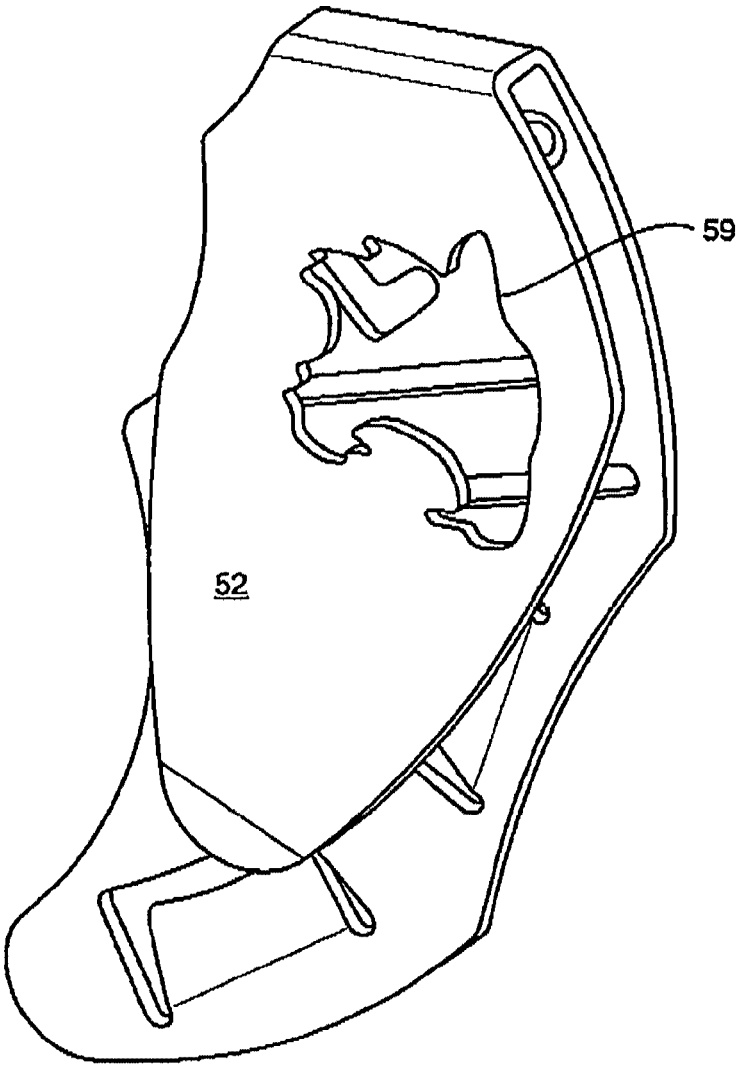
FIG. 5 is a rear view of the alternate embodiment of a backing plate and a clip that can be used in embodiments of the present invention.

FIG. 5 adds a clip 52 to the embodiment shown in FIG. 4. In this embodiment, the clip 52 could be integral to the backing plate 40. Alternatively, the clip 52 could be attached to the backing plate 40 via screws, bolts, rivets, fasteners, and the like. This embodiment also includes a bottle opener 59, which could be numerous shapes, but in this embodiment is depicted as a wolf's head.

Figure 6A:
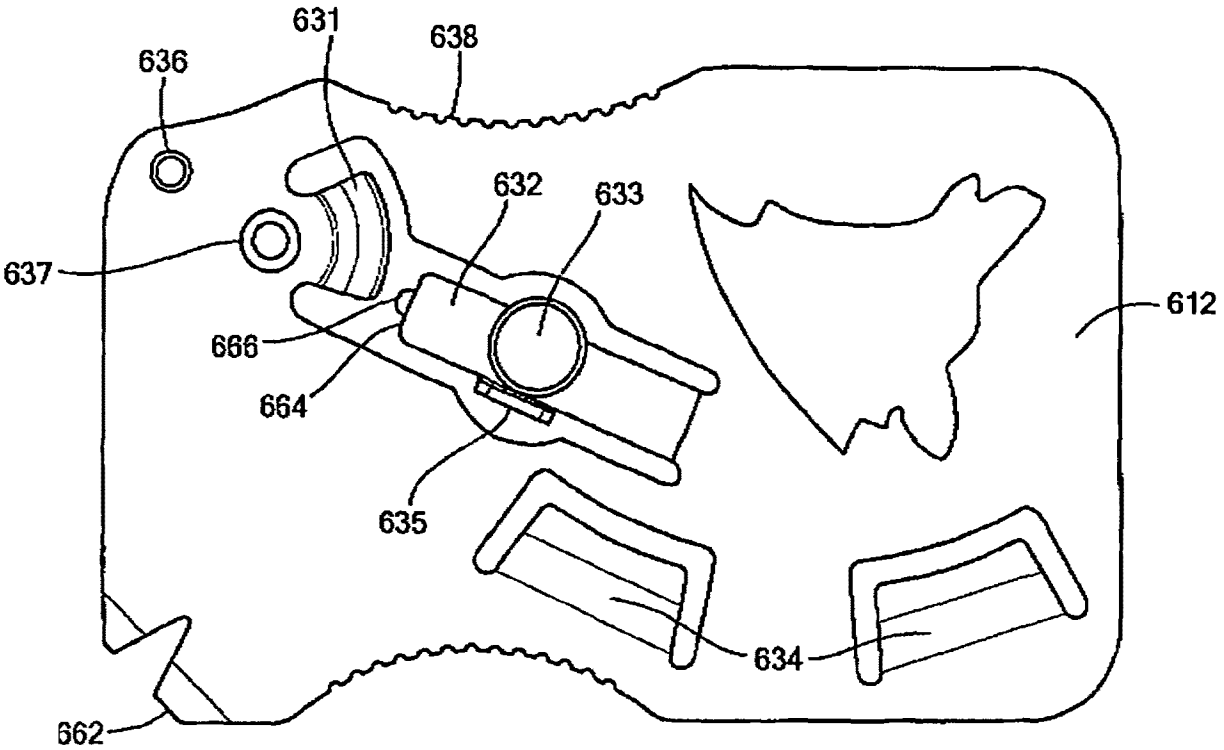
FIG. 6A is a front view of a third embodiment of a backing plate that can be used in the pocket tools described herein.

FIG. 6A shows an alternate embodiment of a backing plate 612 of the present invention. Some of the aspects of this backing plate 612 are similar as those described previously with respect to FIGS. 1-3. For example and without limitation, the implement guard 634 of this embodiment functions and can include the same variations as previously described. Similarly, the implement pivot boss 637 is similar to the implement pivot boss 37 previously described. Likewise, the implement catch portion 633 is similar as previously described with respect to implement catch portion 33, as is the implement retention boss 635 when compared with implement retention boss 35.

The leaf spring 632 functions similarly and has similar attributes as those described with respect to leaf spring 32. Moreover, the backing plate 612 could be constructed to accommodate embodiments where the implement 614 is removable or permanently fixed. Implement retention boss 636 functions similarly as described earlier with respect to implement retention boss 36.

Figure 7:
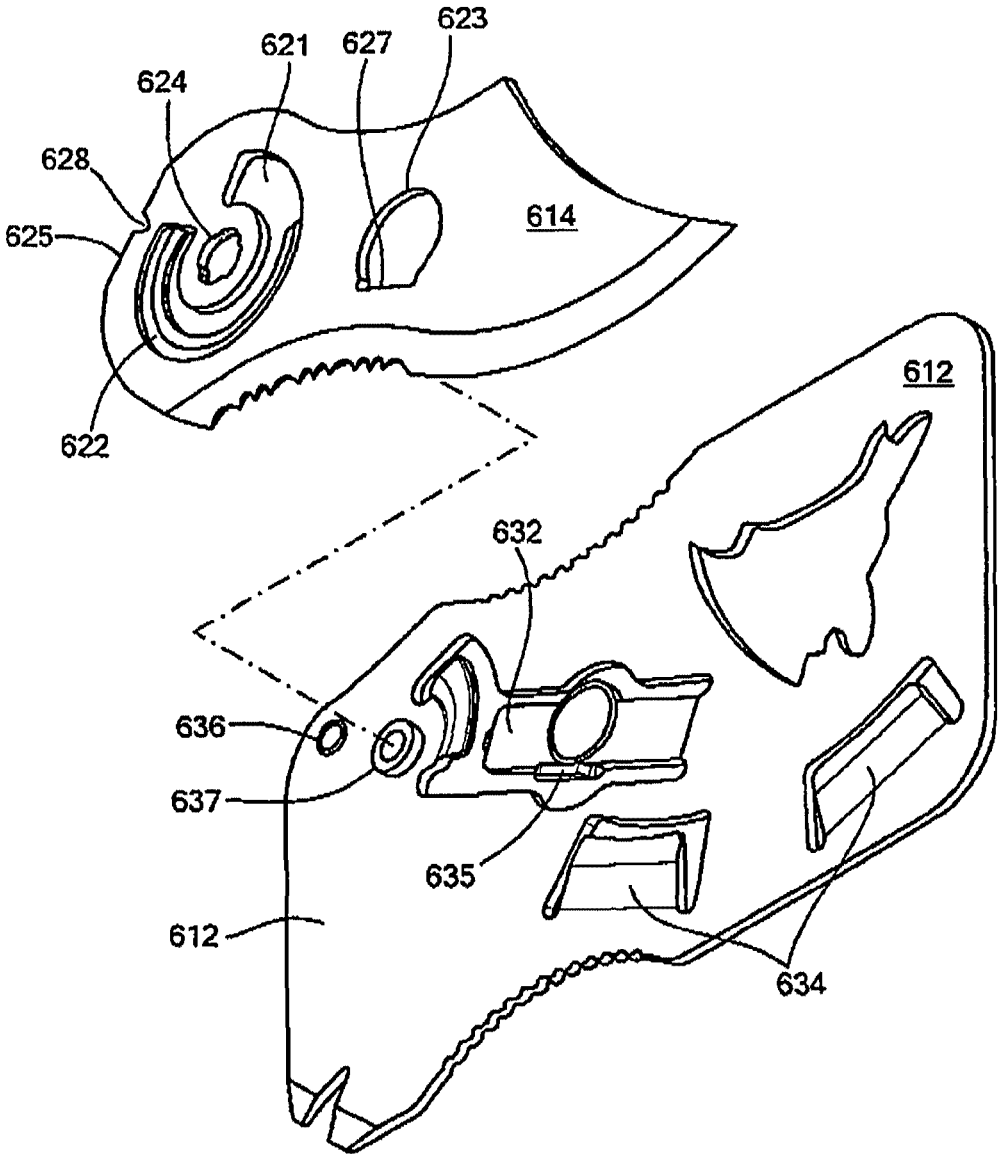
FIG. 7 is a perspective view of the third embodiment of the backing plate and an embodiment of a knife blade that could be used in this embodiment to create a low profile utility tool.

Turning to FIG. 7, the implement 614 of FIG. 7 is similar to embodiments discussed previously. Specifically, the cutout portion 621 and the recessed portion 622 of the orbital track are designed and perform similarly with respect to cutout portion 21 and recessed portion 22. Cutouts 623 and 624 are designed and perform similarly to cutouts 23 and 24. The flat portion of the cutout 627 is designed and performs similarly to the flat portion of cutout 27.

In the embodiment shown in FIG. 6A, the size and shape of the first tab 631 located on the backing plate 612 have been changed from previous embodiments. Specifically, the first tab 631 is larger and is a curved trapezoidal shape. This alteration in the size and shape of the first tab 631 provides enhanced force exerted on the implement 614 during rotation and use. The enhanced force results in greater rotational stability as well as greater rigidity when the implement is in use. In this embodiment, the first tab 631 is integral to the backing plate 612 and could be formed by pressing, stamping, welding, and the like.

In terms of the size of first tab 631, its size could be small enough to allow implement 614 to be removed by rotating the gap between the cutout portion 621 and the recessed portion 622 of the orbital track so that the first tab 631 is positioned within the gap. The first tab 631 should be large enough to provide a stabilizing force to the implement 614 when it is rotating about the orbital track or when it is in the closed position.

Figure 6B:
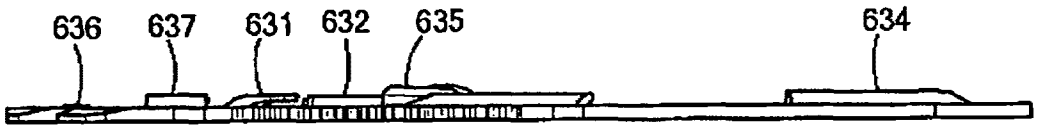
FIG. 6B is a profile view of the third embodiment of the backing plate.

An additional element of the embodiments shown in FIGS. 6A, 6B, and 7 is an implement locking tab 666 and a leaf spring edge 664. These features add stability to the implement 614 when it is in the open position. When notch 628 is securely contained within implement locking tab 666, the connection serves to enhance the stability of the implement 614 when it is in use. Additionally, when the notch 628 circumscribes the implement locking tab 666, additional stabilizing forces will be applied by virtue of the contact between the flat portion of the implement 625 the spring leaf edge 664.

In alternate embodiments, the backing plate 612 could include a multipurpose tool 662.

Referring to FIG. 6A, in one embodiment, the thickness of the flat portion of the backing plate 636 could be approximately equal to the thickness of the protrusions created by the implement pivot boss 637, the first tab 631, the leaf spring 632, the implement retention boss 635, and the implement guard 634. In an alternate embodiment, the combined thickness of the flat portion of the backing plate 636 and protrusions 637, 631, 632, 635, and 634 could be less than or equal to 4 millimeters, for example 4 millimeters, 3 millimeters, or 2 millimeters.

Figure 8:
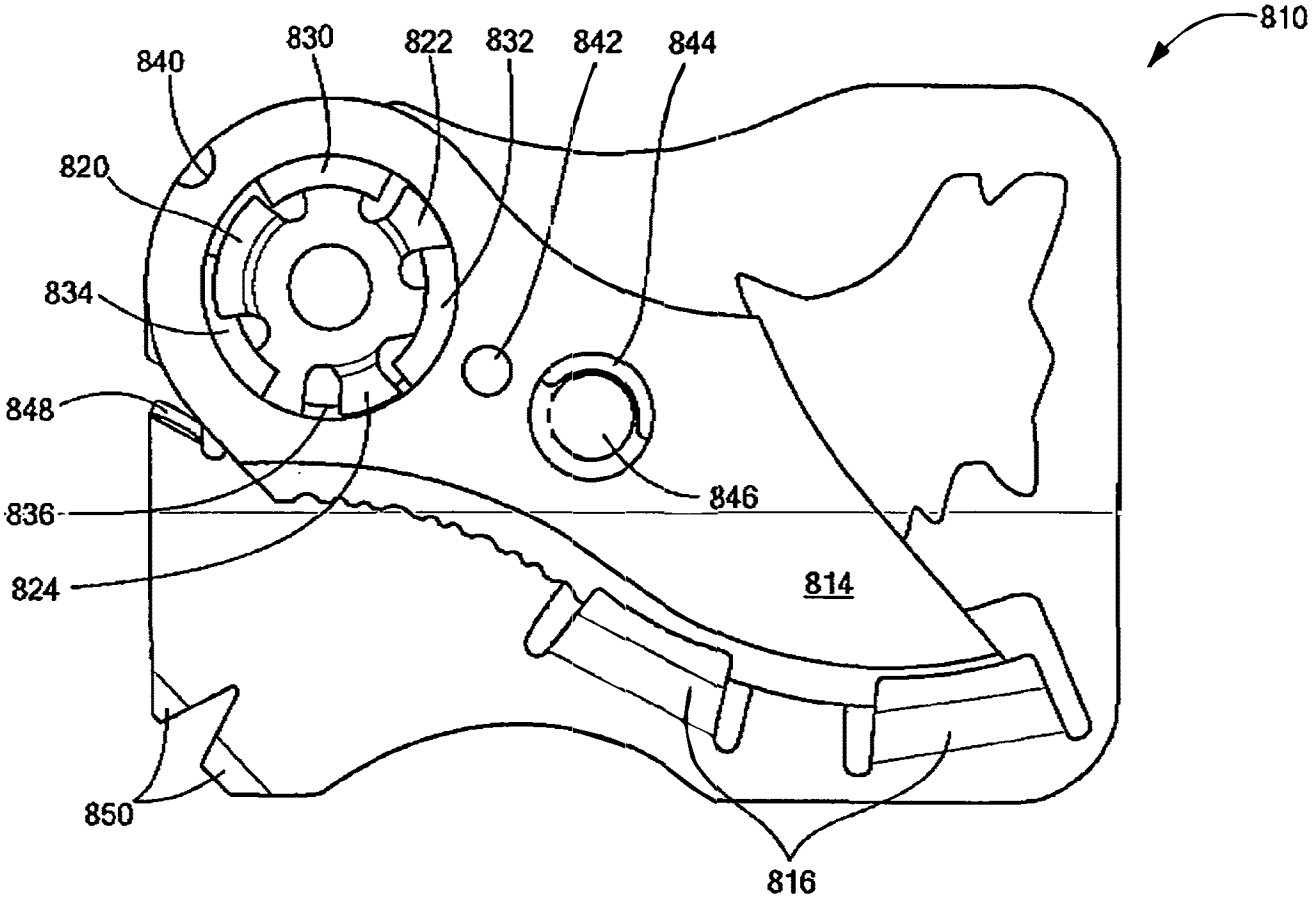
FIG. 8 is a front view of a fourth embodiment of the low profile pocket tool. In this embodiment, the pocket tool is a pocket knife and it is shown in the closed position.
Figure 9:
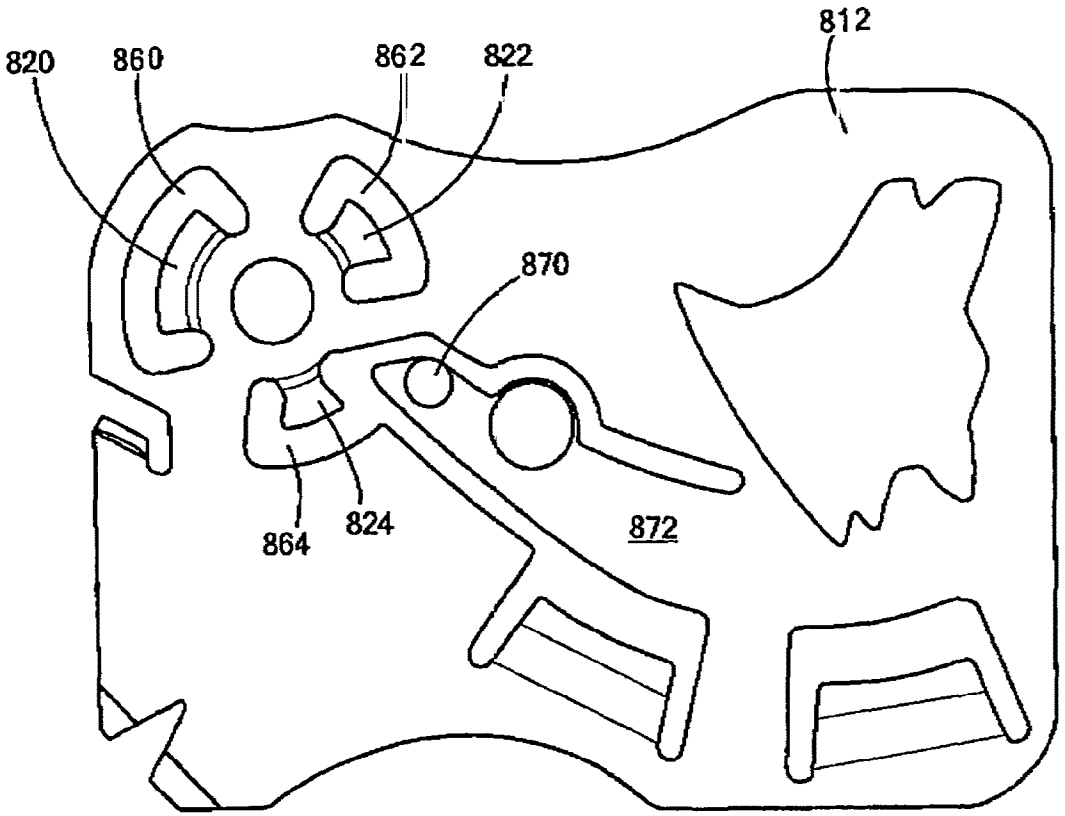
FIG. 9 is a front view of a fourth embodiment of a backing plate that can be used in the pocket tools described herein.
Figure 10:
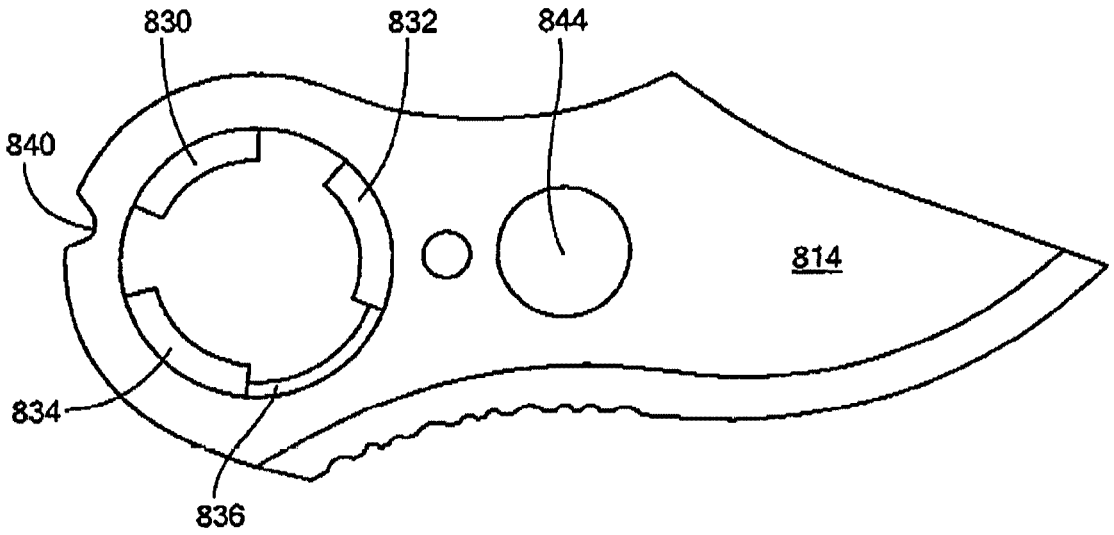
FIG. 10 is a front view of a knife blade that could be used with the fourth embodiment of the backing plate to create a low profile utility tool.
Figure 11:
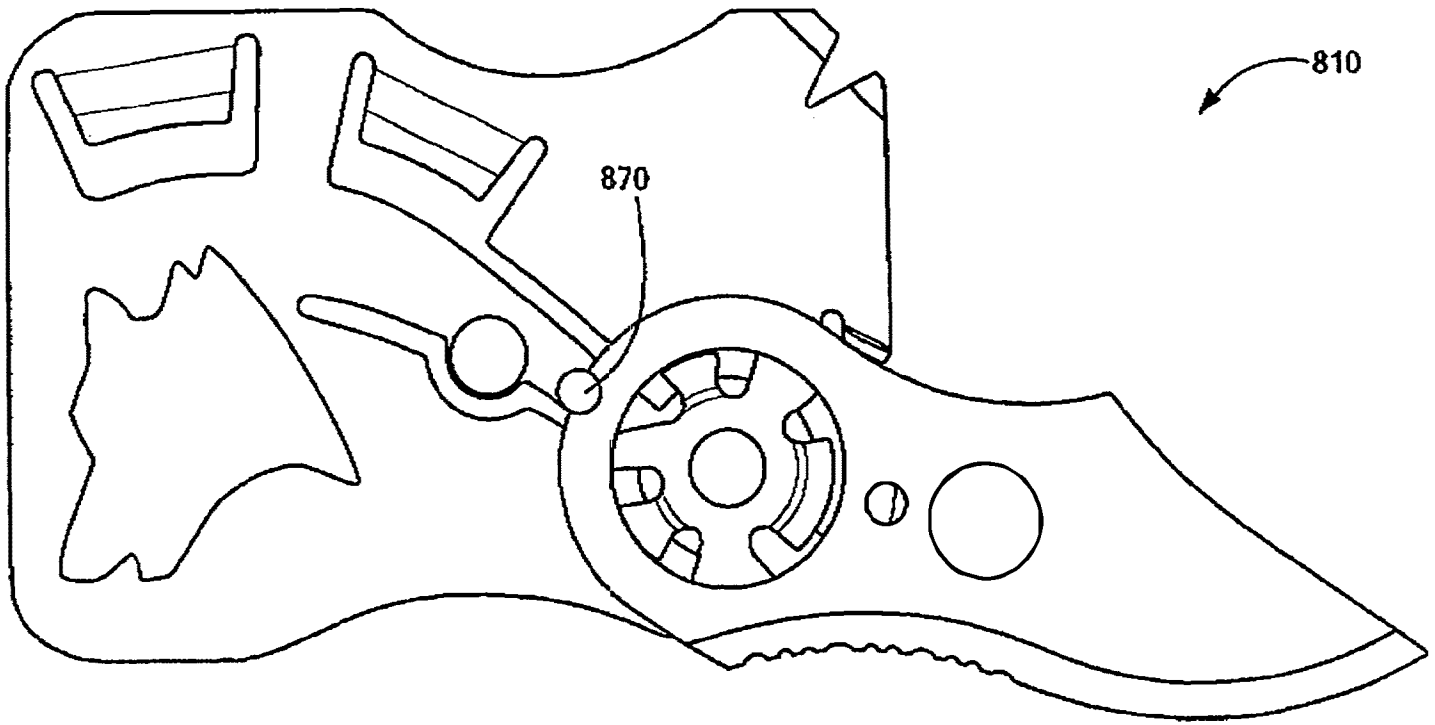
FIG. 11 is a front view of a fourth embodiment of the low profile pocket tool. In this embodiment, the pocket tool is a pocket knife and it is shown in the open position.

FIG. 8 depicts pocket tool 810 embodiments wherein additional tabs have been added to the backing plate. One of the many benefits of adding additional tabs is increased implement or blade stability during rotation and in the open position. This increased implement or blade stability reduces the occurrence of tab deformation that may transpire over time. Specifically, the embodiment depicted in FIG. 8 includes a first tab 820, a second tab 822, and a third tab 824. In an alternate embodiment, there could be only a first tab 820 and a second tab 822. These tabs 820, 822, and 824 can be of varying arc lengths or varying widths. Tabs 820, 822, and 824 are designed to allow rotation of the implement 814 about an orbital track while simultaneously constraining the implement 814 in a plane perpendicular or mostly perpendicular and proximal to the backing plate 812.

In one embodiment, the implement 814 is removable and attachable. The first backing plate cutout 860, the second backing plate cutout 862 and the third backing plate cutout 864 are sized so as to allow implement 814 to rotate in such a way as to allow a first implement pivot track 832, a second implement pivot track 834, a third implement pivot track 836, and a fourth implement pivot track 830 to arrive at an attachment position such that first implement pivot track 832, second implement pivot track 834, third implement pivot track 836, and fourth implement pivot track 830 are able to slip through first backing plate cutout 860, second backing plate cutout 862 and third backing plate cutout 864. In this embodiment, third implement pivot track 836 is narrower than first implement pivot track 832, second implement pivot track 834, and fourth implement pivot track 830. Additionally, first implement pivot track 832, a second implement pivot track 834, a third implement pivot track 836, and a fourth implement pivot track 830 can be integral to backing plate 812.

Figure 12:
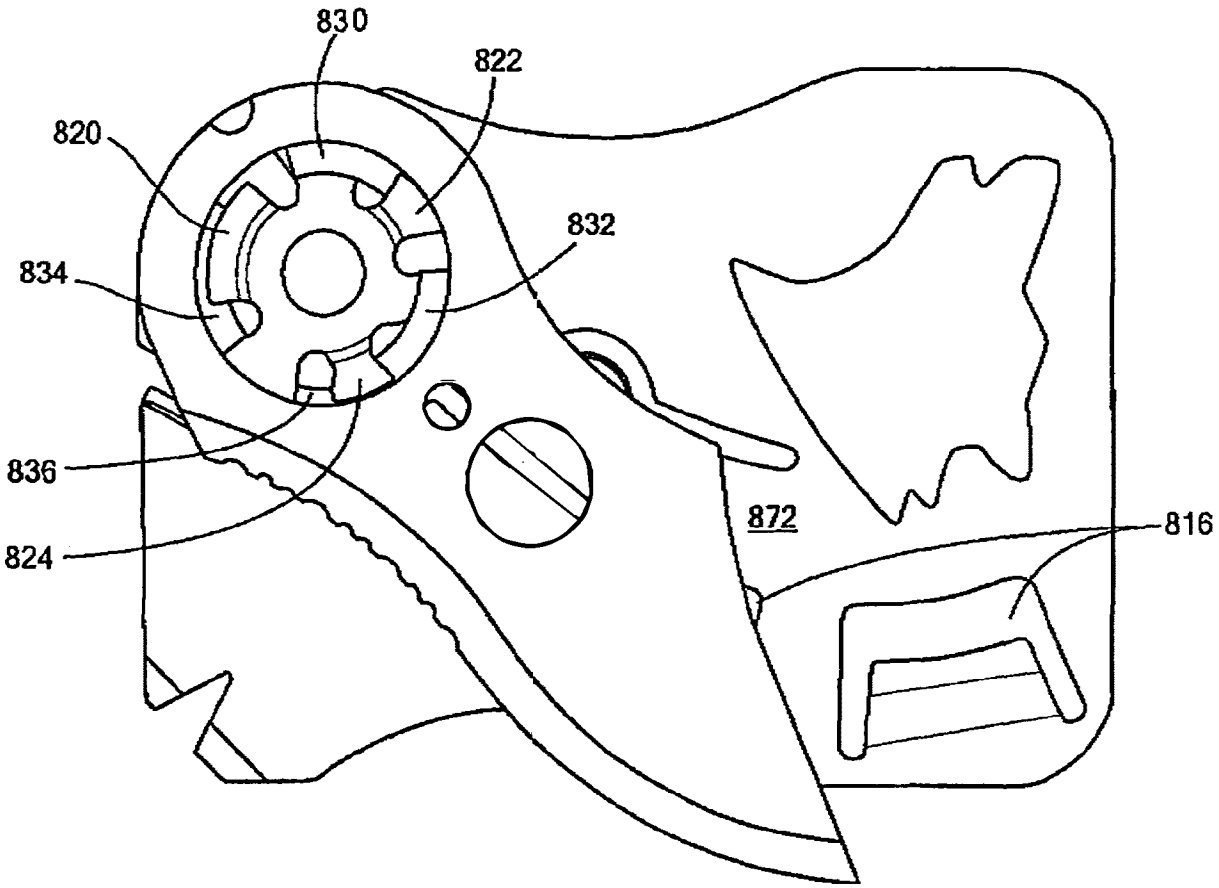
FIG. 12 is a front view of a fourth embodiment of the low profile pocket tool. In this embodiment, the pocket tool is a pocket knife and it is shown in a position that allows the knife blade to be removed upon further rotation of the knife blade.

FIG. 12 depicts implement 814 in an attachment position upon backing plate 812. FIG. 12 depicts the initial phase of removing an implement 814 from being attached to backing plate 812. In this embodiment, implement 814 is removed by pushing down on implement catch portion 846. This force reduces the force applied to the implement 814 by leaf spring 872 and implement catch portion 846, which thereby allows implement 814 to rotate freely and to be rotated up and over implement guard implement 816. In order to remove implement 814, a user can rotate implement 814 clockwise until first implement pivot track 832, second implement pivot track 834, third implement pivot track 836, and fourth implement pivot track 830 to arrive at a position such that first implement pivot track 832, second implement pivot track 834, third implement pivot track 836, and fourth implement pivot track 830 are able to slip through first backing plate cutout 860, second backing plate cutout 862 and third backing plate cutout 864.

In an alternate embodiment, the pocket tool 810 could be comprised of a backing plate having only a first tab and a second tab. In this embodiment, there would be at least two backing plate cutouts as well as two implement pivot tracks. In this embodiment, one of the implement pivot tracks could be narrower than the other implement pivot track. In this embodiment, the implement could be removable or securely attached to the backing plate.

Referring to FIGS. 8-11, in embodiments there could be a leaf spring 872 having an implement catch portion 846 and an implement retention boss 870. The implement retention boss 870 can be sized to securely fit within a third implement cutout 842 thereby adding stability when the implement 814 is in a closed position. Similarly, implement catch coupling 844, which could be a cutout, can be configured to fit securely into an implement catch portion 846 on leaf spring 872. Notch 840 is sized so as to interlock with implement retention boss 870 so as to provide additional stability when the implement 814 is in the open position. Implement stop portion 848 could be a tab pressed, stamped, or bent into backing plate 812. Implement stop portion 848 provides implement stability when the implement is in an open position by providing a downward force on a top portion of the implement 814. Embodiments may optionally include a multi-purpose tool 850 or at least one implement guard 816.

Figure 13:
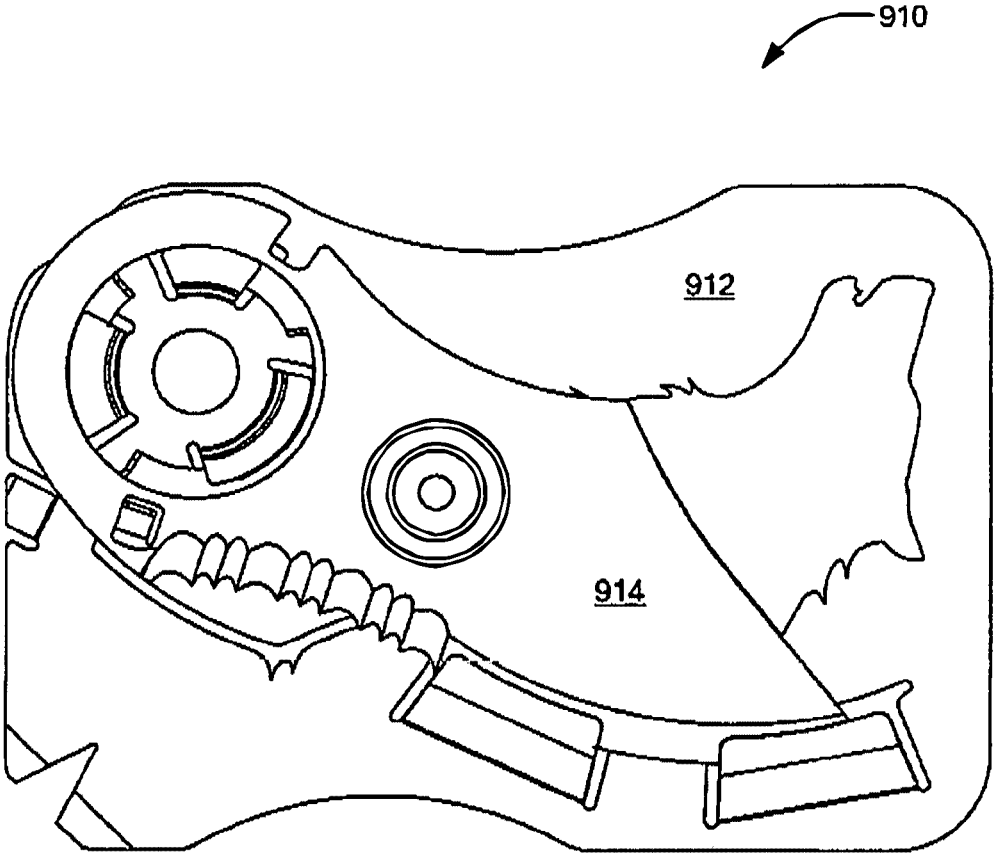
FIG. 13 is a front view of a fifth embodiment of the low profile pocket tool. In this embodiment the low profile pocket tool is a pocket knife shown in the closed position.

An alternate embodiment of the pocket tool 910 is shown in FIG. 13. In this embodiment, there is a backing plate 912 and an implement 914, depicted as a knife blade. Many of the design features of this embodiment are similar to those described above with respect to FIGS. 8-12. For example, the pocket tool 910 also has a backing plate 912 having two or three tabs 920, 922, and 924; a leaf spring 930, at least one implement guard, an implement notch 950, first implement pivot track 942, second implement pivot track 944, third implement pivot track 946, and optionally a fourth implement pivot track 940. In this embodiment, first implement pivot track 942, a second implement pivot track 944, a third implement pivot track 946, and a fourth implement pivot track 940 can be integral to implement 914. Implement 914 can be attached or removed from an attachment position similar to the one described in FIG. 12. For example, to position the implement 914 in the attachment position, first implement pivot track 942, a second implement pivot track 944, a third implement pivot track 946 and a fourth implement pivot track 940 are rotated around backing plate tabs, 920, 922 and 924 respectively, to a position that rotationally disengages backing plate tabs from the pivot tracks.

Figure 14:
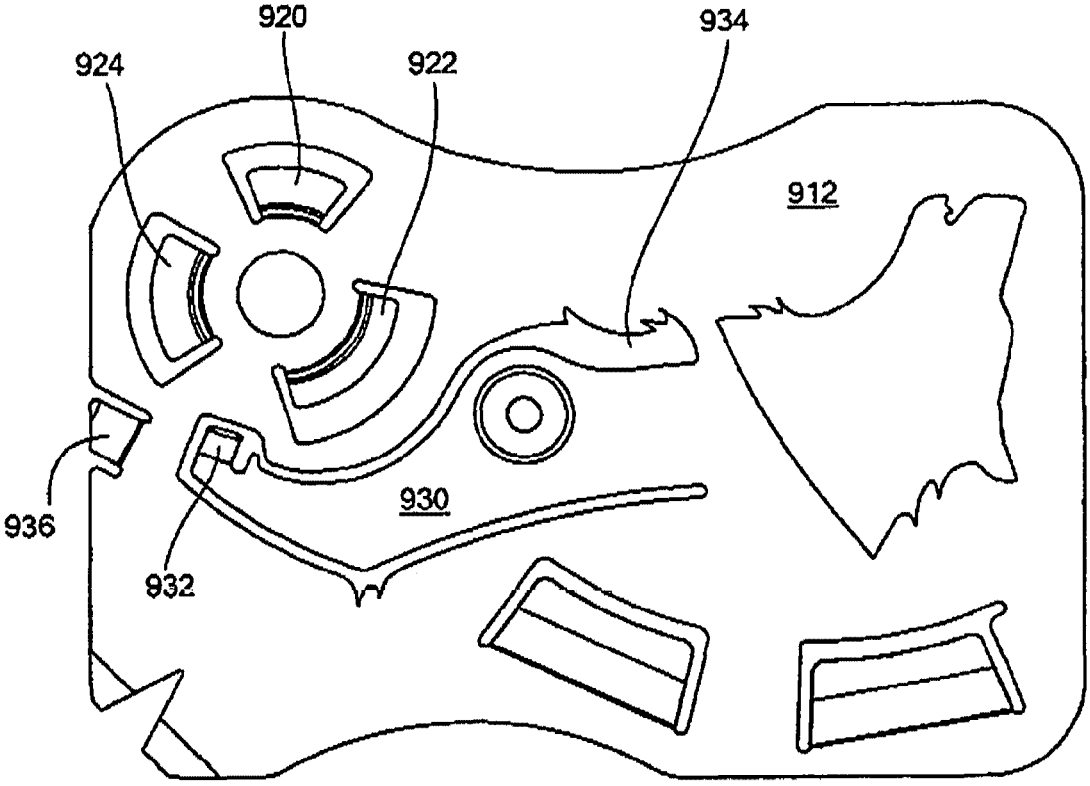
FIG. 14 is a front view of a fifth embodiment of a backing plate that can be used in the pocket tools described herein.
Figure 15:
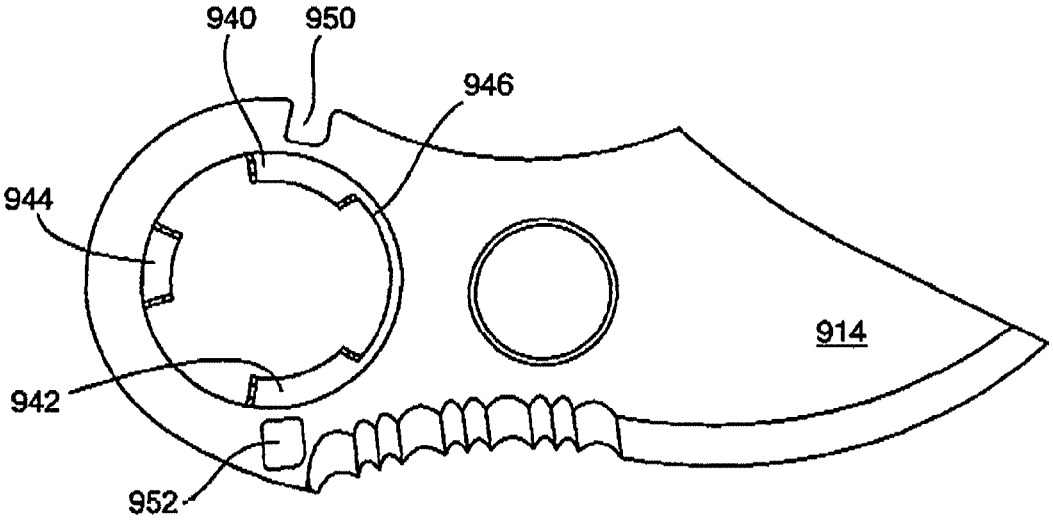
FIG. 15 is a front view of a knife blade that could be used with the fifth embodiment of the backing plate to create a low profile utility tool.
Figure 16:
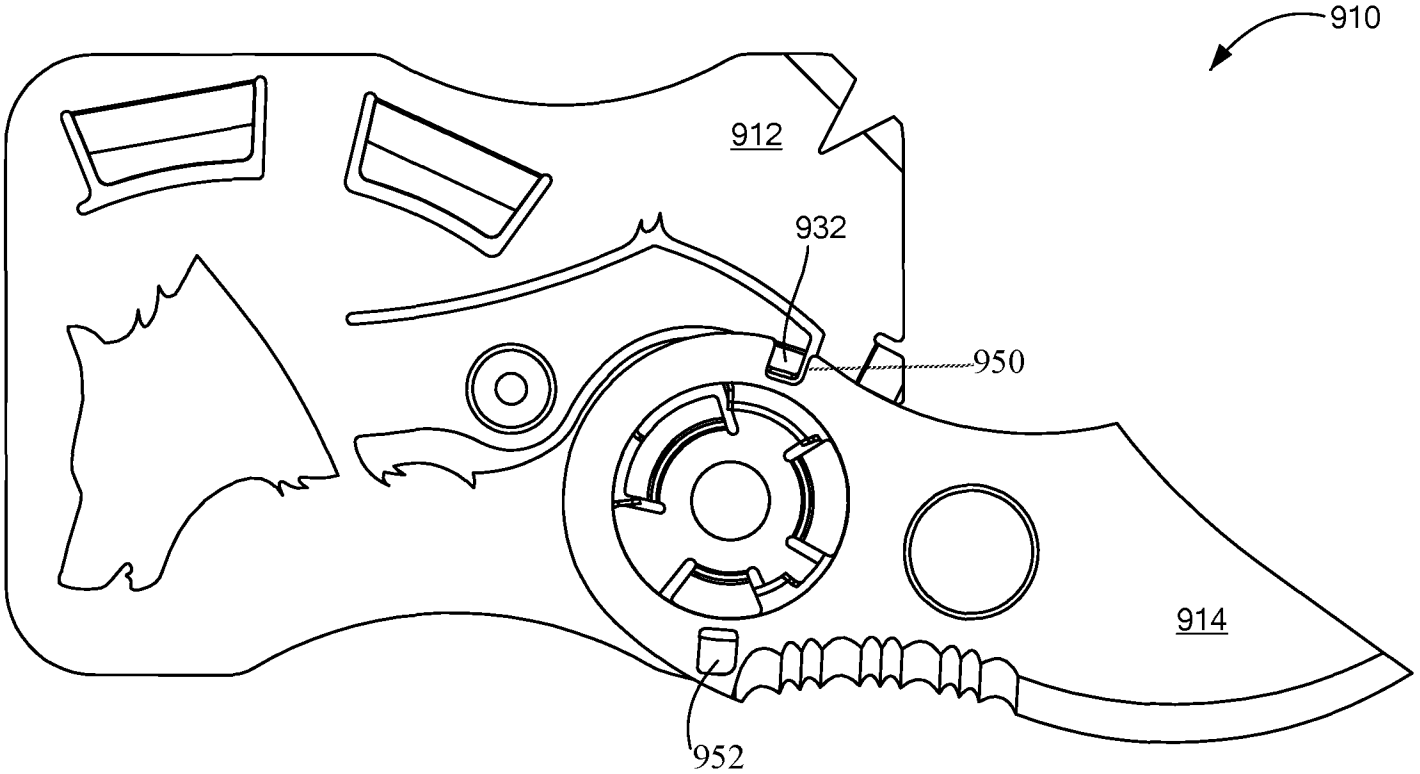
FIG. 16 is a front view of a fifth embodiment of the low profile pocket tool. In this embodiment the low profile pocket tool is a pocket knife shown in the open position.

One difference in the exemplary embodiments of the pocket tool 910 is the provision for an implement catch tab 932 extending from the end of the leaf spring 930, which can be configured to interlock with implement catch cutout 952 thereby increase stability of the implement when it is in the closed position or implement notch 950 to lock the implement 914 in the open position. Additionally, implement catch tab 932 could replace implement retention boss 870, which would result in added stability for the implement 914 both in an open and a closed position. Moreover, backing plate 912 could include a fourth backing plate cutout 934, which by way of example, could be a fanciful design such as the profile of a wolfs body shown in FIG. 14.

Figure 17:
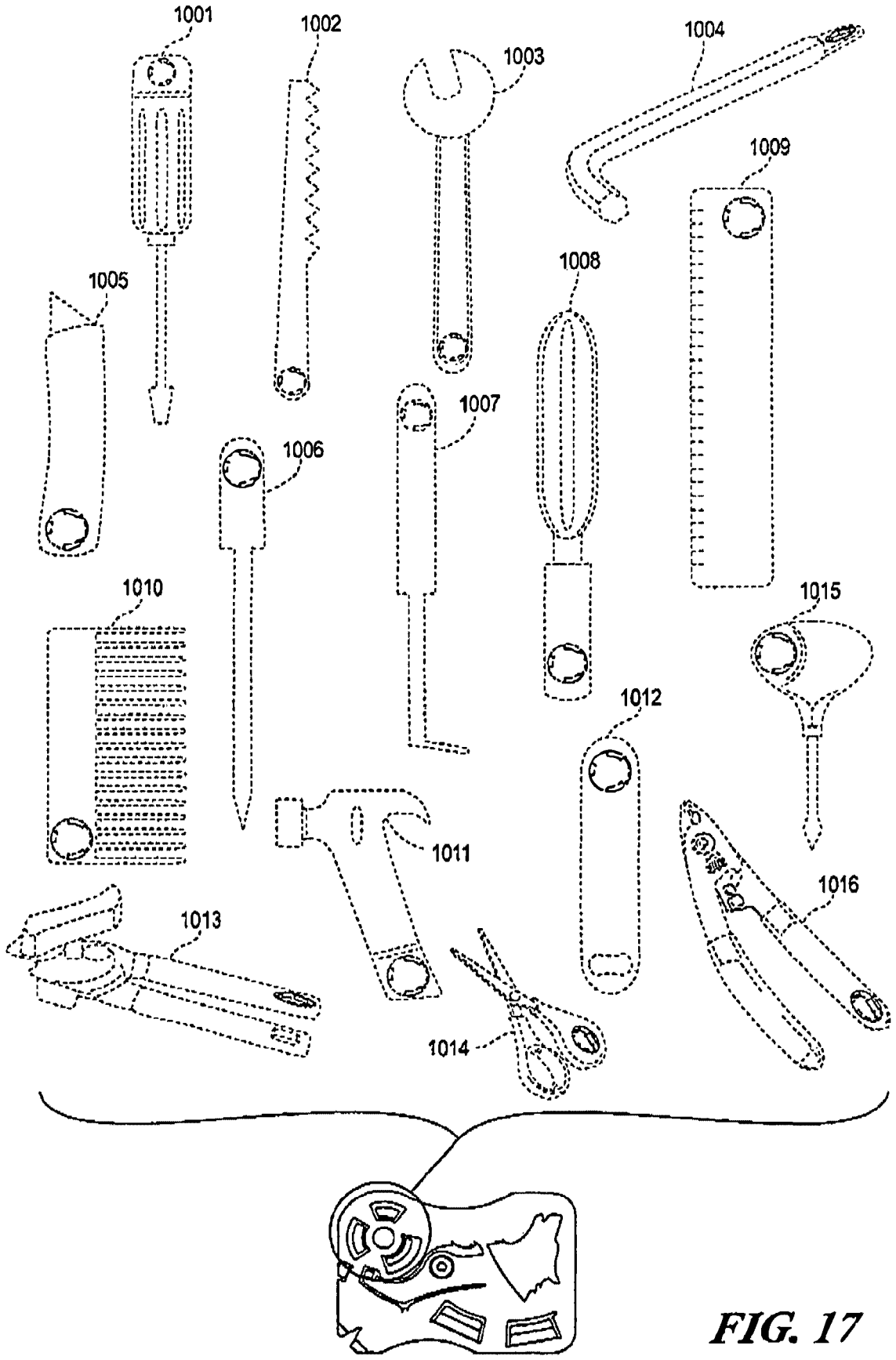
FIG. 17 is a front view of additional implements that could be used with all embodiments of the backing plate to create a low profile utility tool.

FIG. 17 shows alternate implements 914 that could be used with backing plate 912. Specifically, FIG. 17 depicts a screwdriver 1005, a letter opener 1006, a lock pick 1007, a fruit peeler 1008, a ruler 1009, a hair comb 1010, a glass shattering tool 1011, a bottle opener 1012, a can opener 1013, scissors 1014, a chisel 1015, and a wire cutter 1016. Although these implements have been shown with reference to the fifth embodiment, those of skill in the art will readily recognize that these implement variations would work equally well with any of the embodiments discussed herein.

The articles "a" and "an" as used herein in the specification and in the claims, unless clearly indicated to the contrary, should be understood to include the plural referents. Claims or descriptions that include "or" between one or more members of a group are considered satisfied if one, more than one, or all of the group members are present in, employed in, or otherwise relevant to a given product or process unless indicated to the contrary or otherwise evident from the context.

The invention includes embodiments in which exactly one member of the group is present in, employed in, or otherwise relevant to a given product or process. The invention also includes embodiments in which more than one or the entire group of members is present in, employed in or otherwise relevant to a given product or process. Furthermore, it is to be understood that the invention encompasses all variations, combinations, and permutations in which one or more limitations, elements, clauses, descriptive terms, etc., from one or more of the listed claims is introduced into another claim dependent on the same base claim (or, as relevant, any other claim) unless otherwise indicated or unless it would be evident to one of ordinary skill in the art that a contradiction or inconsistency would arise.

Where elements are presented as lists, (e.g., in Markush group or similar format) it is to be understood that each subgroup of the elements is also disclosed, and any element(s) can be removed from the group. It should be understood that, in general, where the invention, or aspects of the invention, is/are referred to as comprising particular elements, features, etc., certain embodiments of the invention or aspects of the invention consist, or consist essentially of, such elements, features, etc. For purposes of simplicity those embodiments have not in every case been specifically set forth in so many words herein. It should also be understood that any embodiment or aspect of the invention can be explicitly excluded from the claims, regardless of whether the specific exclusion is recited in the specification. The entire contents of all of the references (including literature references, issued patents and published patent applications and websites) cited throughout this application are hereby expressly incorporated by reference.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification embodiments have been described in a way which enables a clear and concise specification to be written, but it is intended and will be appreciated, that embodiments may be variously combined or separated without departing from the invention. It is intended that the present invention be limited only to the extent required by the appended claims and the applicable rules of law.

What is claimed is:

1. A low profile pocket tool, comprising:

a backing plate having at least one tab having an arc length and a width; and an implement having at least one track configured and arranged to rotationally engage the at least one tab about the arc length; the implement rotationally positionable relative to the backing plate between an open position wherein said at least one tab engages the at least one track and said implement extends beyond boundaries of said backing plate, a closed position wherein said at least one tab engage the at least one track and said implement is completely within the boundaries of said backing plate, and an attachment position wherein said at least one track is rotated about said arc length to a position that rotationally disengages said at least one tab, which allows said implement to be attachable and removable from said backing plate;

wherein when rotating from the open position to the attachment position the implement passes through the closed position.

2. The tool of claim 1, wherein the at least one track is defined, in part, by at least one cutout portion on the implement.

3. The tool of claim 1, wherein the at least one tab on the backing plate is defined by at least one cutout on the backing plate.

4. The tool of claim 1, further comprising a leaf spring on the backing plate, the leaf spring configured and arranged to lock the implement in one or both of the open position and the closed position.

5. The tool of claim 1, further comprising at least one implement guard extending from the backing plate, the at least one implement guard configured and arranged to receive an end of the implement when in the closed position.

6. The tool of claim 1, wherein said at least one tab of said backing plate comprises a plurality of tabs rotationally spaced apart from each other, wherein said at least one track of said implement comprises a plurality of tracks rotationally spaced apart from each other said implement rotationally positionable relative to said backing plate, wherein said plurality of tabs engages the said plurality of tracks and said implement extends beyond boundaries of said backing plate, a closed position wherein said plurality of tabs engage the plurality of tracks and said implement is completely within the boundaries of said backing plate, and an attachment position wherein said plurality of tracks are rotated about said arc length to a position that rotationally disengages said plurality of tabs, which allows said implement to be attachable and removable from said backing plate.

7. The tool of claim 6, wherein the arc length of the first tab is different from the arc length of the plurality of tabs.

8. The tool of claim 6, wherein the width of the first tab is different from the width of the plurality of tabs.

9. A low profile pocket tool, comprising:

a backing plate having at least one tab and; and an implement having at least one track having a recessed portion and a cutout portion, said at least one tab is sized and dimensioned to pass through the cutout portion of said at least one track, the recessed portion is configured for secure rotation of said implement within the at least one track and engaging the at least one tab, coupling the implement to the backing plate in movable relation thereto;

said backing plate having at least one implement guard, wherein the implement is rotationally positionable relative to the backing plate between an open position wherein said at least one tab engages the at least one track when said implement extends beyond boundaries of said backing plate, a closed position wherein said at least one tab engage the at least one track when said implement is rotationally aligned with at least one implement guard, and an attachment position wherein said at least one tab is rotationally aligned with said cutout portion for attachment and removal of said implement;

wherein when rotating from the open position to the attachment position the implement passes through the closed position.

10. The tool of claim 9, wherein the at least one tab comprises a plurality of tabs and the at least one track comprises a plurality of tracks, wherein each of the plurality of tracks comprises a recessed portion and a cutout portion, wherein each of the plurality of tabs corresponds to one of plurality of cutout portions, wherein said plurality of tabs are sized and dimensioned to pass through the plurality of cutout portions of said plurality of tracks.

11. The tool of claim 9, wherein the at least one tab rotationally engages the recessed portion of the at least one track, allowing pivotal movement of the implement relative to the backing plate.

* * * * *